US010305209B2

(12) United States Patent
Ishishita

(10) Patent No.: US 10,305,209 B2
(45) Date of Patent: May 28, 2019

(54) ELECTRICAL CONNECTOR AND METHOD OF ASSEMBLING THE SAME

(71) Applicant: Amphenol FCI Asia Pte Ltd, Singapore (SG)

(72) Inventor: Takahisa Ishishita, Saitama (JP)

(73) Assignee: Amphenol FCI Asia Pte Ltd, Singapore (SG)

( * ) Notice: Subject to any disclaimer, the term of this patent is extended or adjusted under 35 U.S.C. 154(b) by 0 days.

(21) Appl. No.: 15/442,163

(22) Filed: Feb. 24, 2017

(65) Prior Publication Data

US 2017/0250483 A1 Aug. 31, 2017

(30) Foreign Application Priority Data

Feb. 26, 2016 (SG) ..... 10201601462P

(51) Int. Cl.
*H01R 12/77* (2011.01)
*H01R 13/633* (2006.01)
*H01R 12/79* (2011.01)

(52) U.S. Cl.
CPC ..... *H01R 12/774* (2013.01); *H01R 12/79* (2013.01); *H01R 13/633* (2013.01)

(58) Field of Classification Search
CPC ..... H01R 12/774; H01R 12/79; H01R 13/633
USPC ..... 439/59
See application file for complete search history.

(56) References Cited

U.S. PATENT DOCUMENTS 7,695,311 B2 4/2010 Nemoto
8,002,567 B2 * 8/2011 Hara ..... H01R 12/89 439/329
8,221,147 B2 * 7/2012 Ozeki ..... H01R 12/88 439/260

(Continued)

FOREIGN PATENT DOCUMENTS

CN 101242043 A 8/2008
CN 102142631 A 8/2011

(Continued)

OTHER PUBLICATIONS

International Search Report and Written Opinion for International Application No. PCT/SG2016/050424 dated Nov. 29, 2016.

(Continued)

*Primary Examiner* — Alexander Gilman
(74) *Attorney, Agent, or Firm* — Wolf, Greenfield & Sacks, P.C.

(57) ABSTRACT

An electrical connector comprises a housing, a plurality of contacts arranged in the housing, an actuator mounted on the housing, capable of rotating with reference to the housing and a pair of fixing tabs positioned in the vicinity of two ends of the actuator. Each fixing tab has a lock portion for engaging with a flexible printed circuited connected to the electrical connector and a spring portion connected to the lock portion. The fixing tab is engaged with the actuator so that rotation of the actuator from an original position to a release position causes the lock portion of the fixing tab to disengage with the flexible printed circuit connected to the electrical connector and the actuator resumes from the release position to the original position under a resilient force exerted thereon by the spring portion of the fixing tab.

20 Claims, 12 Drawing Sheets

(56) References Cited

U.S. PATENT DOCUMENTS

| | | | | |
|---|---|---|---|---|
| 8,371,880 | B2 * | 2/2013 | Ishimaru | H01R 12/61 439/632 |
| 8,376,762 | B2 * | 2/2013 | Ozeki | H01R 12/79 439/153 |
| 8,398,417 | B2 * | 3/2013 | Ozeki | H01R 12/774 439/260 |
| 8,444,427 | B2 * | 5/2013 | Hashimoto | H01R 12/774 439/325 |
| 8,512,058 | B2 * | 8/2013 | Ozeki | H01R 12/772 439/260 |
| 8,651,885 | B2 * | 2/2014 | Ashibu | H01R 12/774 439/328 |
| 8,678,844 | B2 * | 3/2014 | Yoshisuji | H01R 12/592 439/260 |
| 8,747,133 | B2 * | 6/2014 | Shen | H01R 12/7005 439/157 |
| 8,851,918 | B2 * | 10/2014 | Yoshisuji | H01R 13/639 439/260 |
| 8,968,020 | B2 | 3/2015 | Nishiyama | |
| 9,054,451 | B2 | 6/2015 | Tateishi et al. | |
| 9,065,210 | B2 | 6/2015 | Narita | |
| 9,088,115 | B2 | 7/2015 | Komoto et al. | |
| 9,153,888 | B2 | 10/2015 | Kajiura et al. | |
| 9,466,903 | B2 | 10/2016 | Kajiura et al. | |
| 9,640,884 | B2 | 5/2017 | Sasame et al. | |
| 2008/0050966 | A1 * | 2/2008 | Hashiguchi | H01R 12/57 439/495 |
| 2010/0261369 | A1 * | 10/2010 | Satoh | H01R 12/79 439/328 |
| 2010/0304591 | A1 * | 12/2010 | Ishishita | H01R 12/79 439/260 |
| 2011/0136365 | A1 | 6/2011 | Hara | |
| 2012/0220171 | A1 | 8/2012 | Shimada et al. | |
| 2012/0329300 | A1 | 12/2012 | Ikari | |
| 2014/0073166 | A1 * | 3/2014 | Kim | H01R 12/772 439/345 |
| 2015/0171536 | A1 | 6/2015 | Kameda et al. | |
| 2015/0311620 | A1 * | 10/2015 | Tateishi | H01R 13/46 439/630 |
| 2016/0099511 | A1 * | 4/2016 | Ozeki | H01R 12/88 439/630 |
| 2016/0336668 | A1 * | 11/2016 | Kim | H01R 12/79 |

FOREIGN PATENT DOCUMENTS

| | | | |
|---|---|---|---|
| CN | 102651519 | A | 8/2012 |
| CN | 102842811 | A | 12/2012 |
| CN | 103390810 | A | 11/2013 |
| CN | 103633471 | A | 3/2014 |
| CN | 104051904 | A | 9/2014 |
| CN | 204885665 | U | 12/2015 |
| EP | 2330688 | A | 6/2011 |
| EP | 2493023 | A2 | 8/2012 |
| EP | 2 568 538 | A1 | 3/2013 |
| JP | 4353436 | B2 | 10/2009 |
| JP | 2011-119162 | A | 6/2011 |
| JP | 2012-109059 | A | 6/2012 |
| JP | 2012-174522 | A | 9/2012 |
| JP | 2014-179300 | A | 9/2014 |
| JP | 2015-026447 | A | 2/2015 |
| KR | 10-2011-0065309 | A | 6/2011 |
| KR | 10-2012-0096414 | A | 8/2012 |
| WO | 2012/008353 | A1 | 1/2012 |

OTHER PUBLICATIONS

International Preliminary Report on Patentability for International Application No. PCT/SG2016/050424 dated Mar. 15, 2018.
U.S. Appl. No. 15/755,758, filed Feb. 27, 2018, Motoyama.
PCT/SG2016/050424, Nov. 29, 2016, International Search Report and Written Opinion.
PCT/SG2016/050424, Mar. 15, 2018, International Preliminary Report on Patentability.
Extended European Search Report for European Application No. 16842435.6 dated Mar. 19, 2019.

* cited by examiner

ELECTRICAL CONNECTOR AND METHOD OF ASSEMBLING THE SAME

CROSS-REFERENCE TO RELATED APPLICATION

This application claims priority to and the benefit of Republic of Singapore Patent Application Number 10201601462P, filed Feb. 26, 2016, which application is hereby incorporated herein by reference in its entirety to the maximum extent allowably by law.

FIELD OF THE INVENTION

The present invention relates to an electrical connector and a method of assembling the same.

BACKGROUND

Electrical connectors are widely used in electrical apparatus for communication, data storage, data transmission and the like. Particularly, flexible printed circuit (FPC) connectors or flexible flat cable (ITC) connectors are often used to connect flat circuit devices to main printed circuit boards (PCB).

One type of the FPC or FFC connectors comprises a locking component to lock a FPC or FFC connected to the connector to prevent the FPC or FFC from unintentional disconnection from the connector and to ensure stable connection therebetween.

SUMMARY

According to an embodiment, an electrical connector comprises a housing, a plurality of contacts arranged in the housing, an actuator mounted on the housing, capable of rotating with reference to the housing and a pair of fixing tabs positioned in the vicinity of two ends of the actuator. Each of the fixing tabs has a lock portion for engaging with a flexible printed circuited connected to the electrical connector and a spring portion connected to the lock portion. The fixing tab is engaged with the actuator so that rotation of the actuator from an original position to a release position causes the lock portion of the fixing tab to disengage from the flexible printed circuit connected to the electrical connector and the actuator resumes from the release position to the original position under a resilient force exerted thereon by the spring portion of the fixing tab.

BRIEF DESCRIPTION OF THE DRAWINGS

The accompanying figures, where like reference numerals refer to identical or functionally similar elements throughout the separate views and which together with the detailed description below are incorporated in and form part of the specification, serve to illustrate various embodiments and to explain various principles and advantages in accordance with the present invention.

Skilled artisans will appreciate that elements in the figures are illustrated for simplicity and clarity and may necessarily be depicted to scale. For example, the dimensions of some of the elements may be exaggerated in respect to other elements to help improve understanding of the embodiments.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description. It is the intent of the present embodiment to provide an advantageous high speed shielded FPC or FFC connector having reduced operation process.

Figure 1:
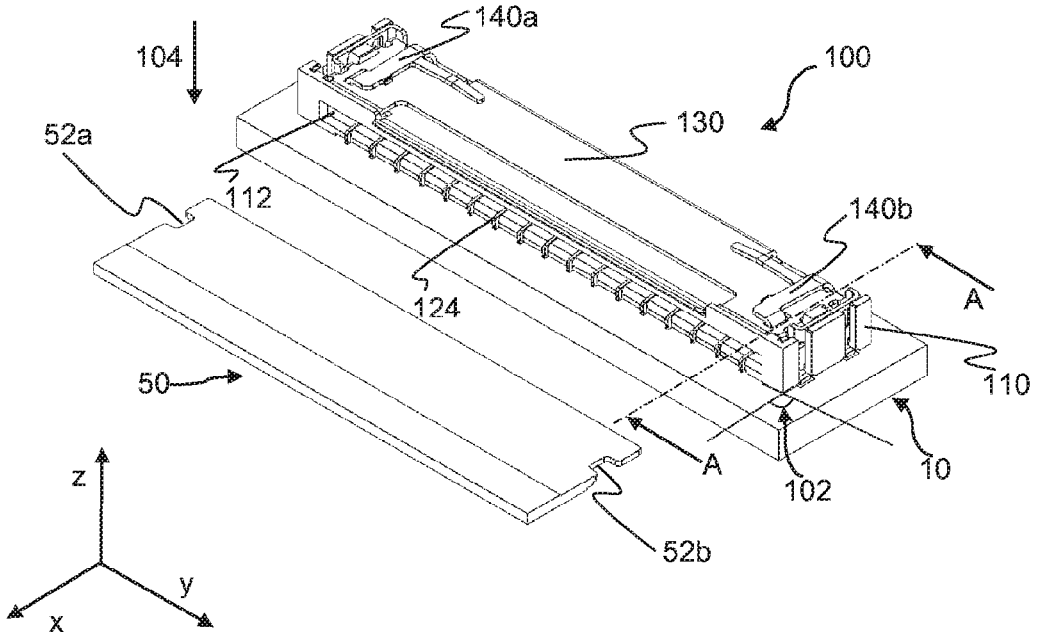
FIG. 1 is a top front perspective view of an electrical connector in accordance with one embodiment, mounted to a PCB and an FPC to be connected to the electrical connector.
Figure 2:
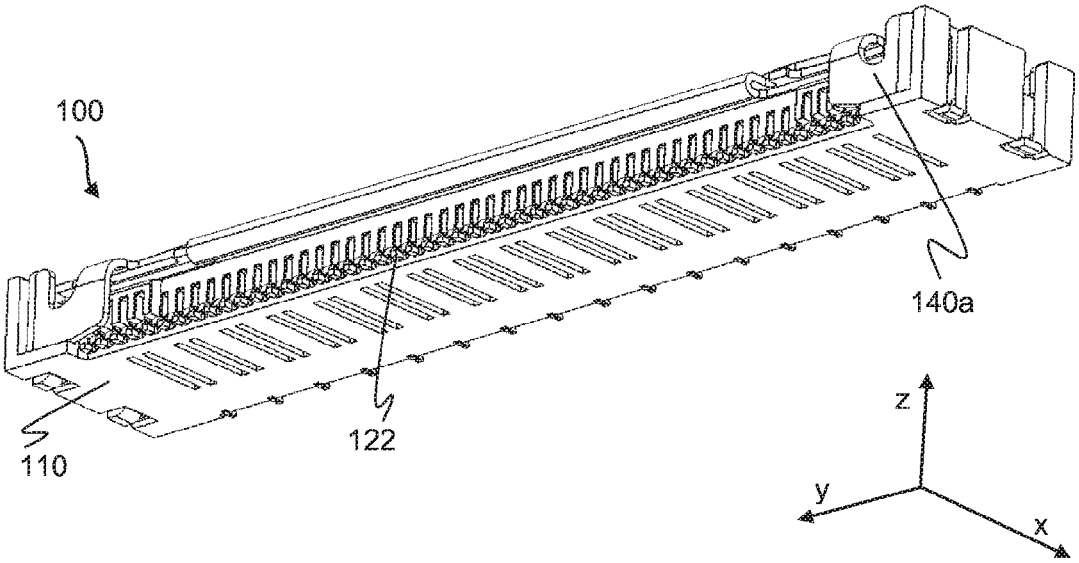
FIG. 2 is a bottom back perspective view of the electrical connector of FIG. 1.
Figure 3:
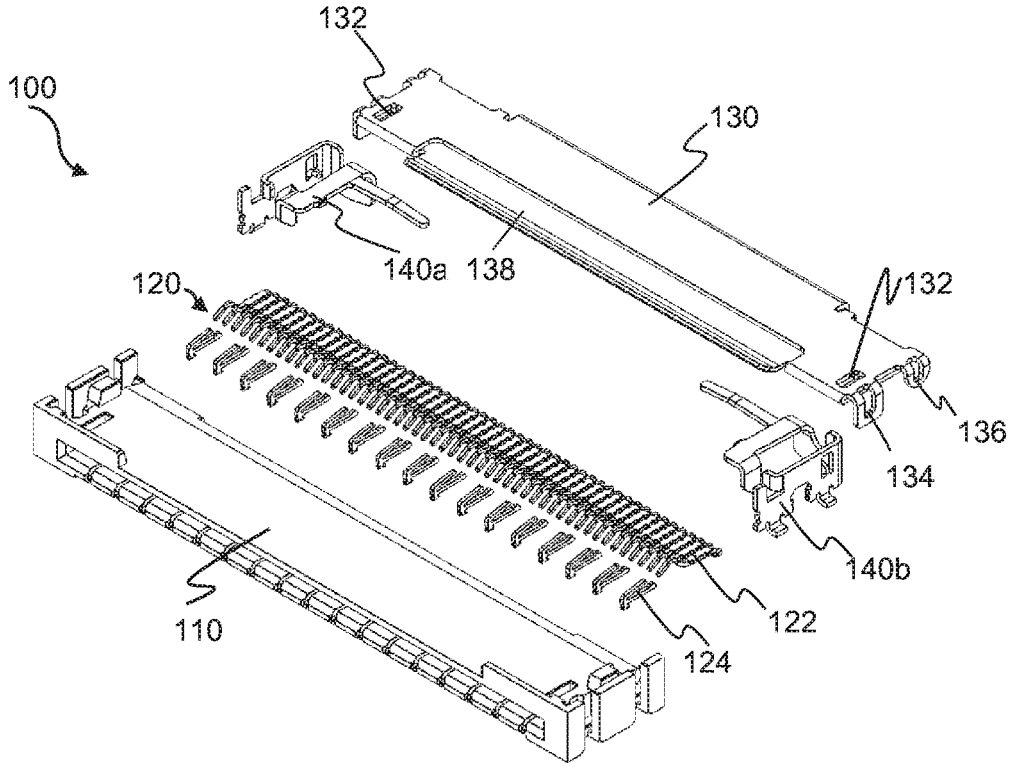
FIG. 3 is an exploded perspective view of the electrical connector of FIG. 1.

FIG. 1 shows an electrical connector 100 in accordance with one embodiment of the present invention and an FPC 50 that can be connected to the connector 100. FIG. 2 is a bottom perspective view of the connector 100 shown in FIG. 1. FIG. 3 is an exploded view of the connector 100. In use, the connector 100 is mounted to a PCB 10 at mounting plane 102 of connector 100, as shown in FIG. 1.

To assist clear understanding, an x-y-z axis system is shown in the figures with xy plane parallel to the mounting plane 102 of the connector 100 and z axis parallel to the mounting direction 104 of the connector 100 to PCB 10. Also, description of 'upward' and 'downward' is intended to mean direction of movement and orientation of structural features along the positive z axis and negative z axis, respectively; description of 'front' and 'back' is intended to mean direction of movement and orientation of structural features along the positive x axis and negative x axis, respectively. Further, description of 'left' and 'right' is intended to mean direction of movement and orientation of structural features along the negative y axis and positive y axis, respectively.

The connector 100 comprises a housing 110, a plurality of contacts 120 arranged in the housing 110, an actuator 130 made of e.g. metal mounted on top of the housing 110 and two fixing tabs 140*a* and 140*b* each being mounted to housing 110 and located in the vicinity of an end of the actuator 130. The housing 110 has a slot 112 opening at the front end thereof for receiving an FPC or an FFC.

The plurality of contacts 120 includes a row of signal contacts 122 positioned in the vicinity of the back end of the housing 110 and a row of ground contacts 124 positioned in the vicinity of the front end of the housing 110. An end portion of the signal contacts 122 extends outside of the housing 110 for electrically connecting to PCB 10. The plurality of contacts 120 is to electrically connect with an FPC or an FFC inserted into housing 110 via slot 112. The actuator 130 has an acting portion 138, two openings 132 each formed at one side end portion of the actuator 130, and limiting components 134 and 136 extending downward from each of a left edge and a right edge of the actuator 130. Each limiting component 134 and 136 has an aperture formed therein. The actuator 130 in connection with the fixing tabs 140*a* and 140*b* shields the plurality of contacts 120 of the connector 100 from electromagnetic interference coming from the top, left and right sides of the connector 100.

Figure 4:
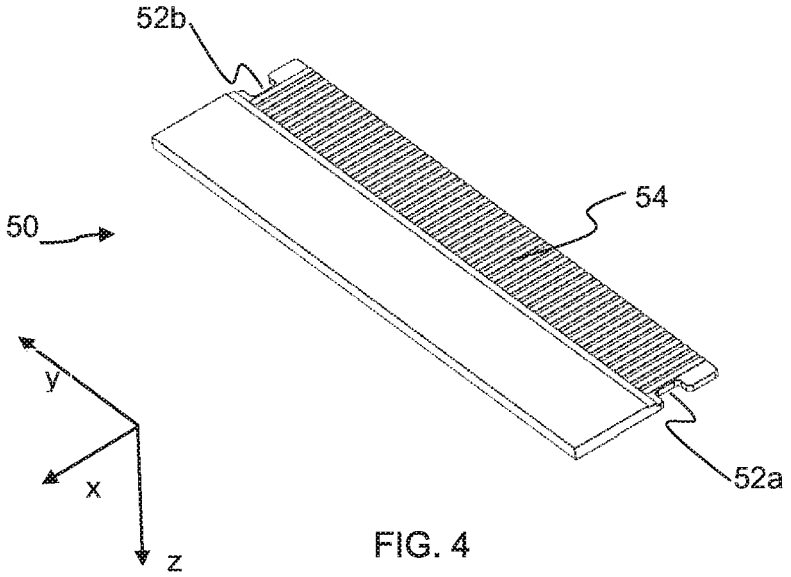
FIG. 4 is a bottom perspective view of an FPC.

FIG. 4 is a bottom perspective view of the FPC 50. The FPC 50 has two recesses 52*a* and 52*b* at opposite sides thereof for engaging with the connector 100, and a plurality contacts 54 for electrically connecting with the connector 100. Through the connector 100, the FPC 50 can be electrically connected to a PCB to which the connector 100 is mounted.

Figure 5:
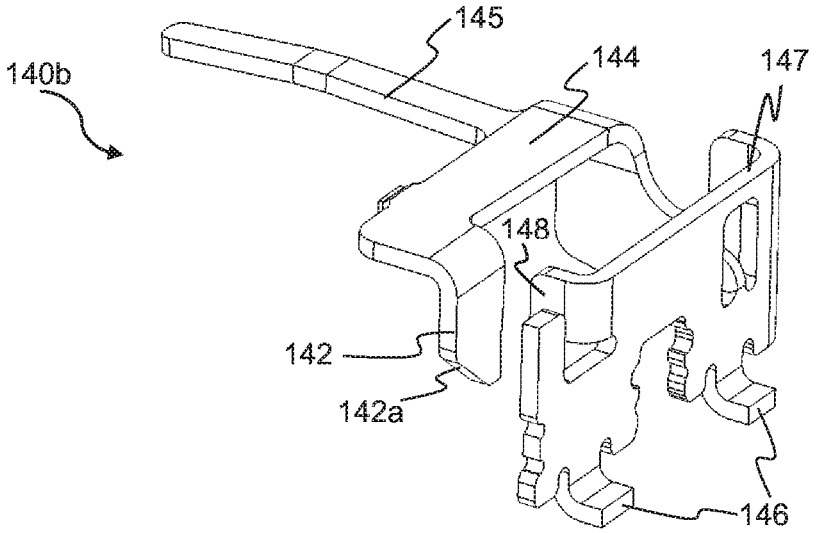
FIG. 5 is a perspective view of a fixing tab of the electrical connector of FIG. 1.
Figure 6:
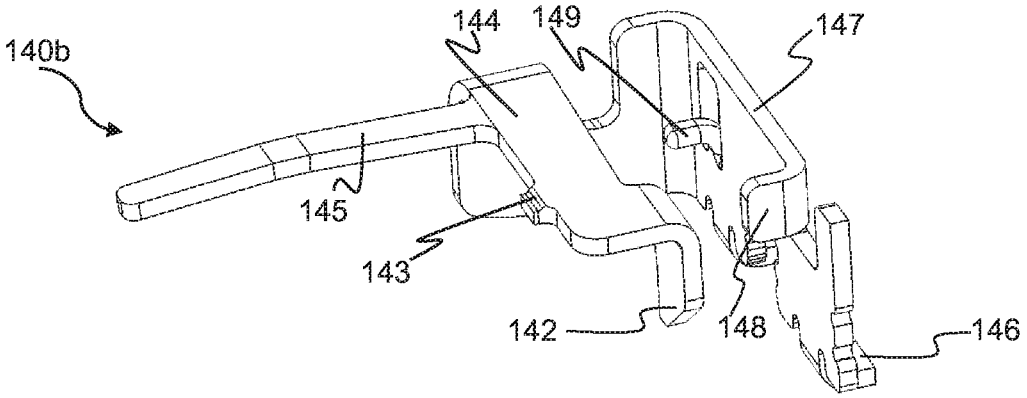
FIG. 6 is a perspective view of a fixing tab of the electrical connector of FIG. 1.

FIG. 5 and FIG. 6 are perspective views of the fixing tab 140*b* positioned at the right side of the connector 100 as seen in FIG. 1. Fixing tab 140*a* and 140*b* have mirror structures. Accordingly, the below description with reference to the fixing tab 140*b* positioned at the right side of the connector 100 equally applies to the fixing tab 140*a* positioned at the left side of the connector 100.

Fixing tab 140*b* as seen in FIG. 5 and FIG. 6 has a lock portion 142, a spring portion 144 connected to the lock portion 142, a contact portion 145 extended laterally from the spring portion 144, a support plate 147 connected to the spring portion 144 and extending toward the mounting plane 102. Support plate 147 has two soldering portions 146 for soldering fixing tab 140*b* to a PCB, and protrusions 148 and 149 extending toward the spring portion 144.

Figure 7:
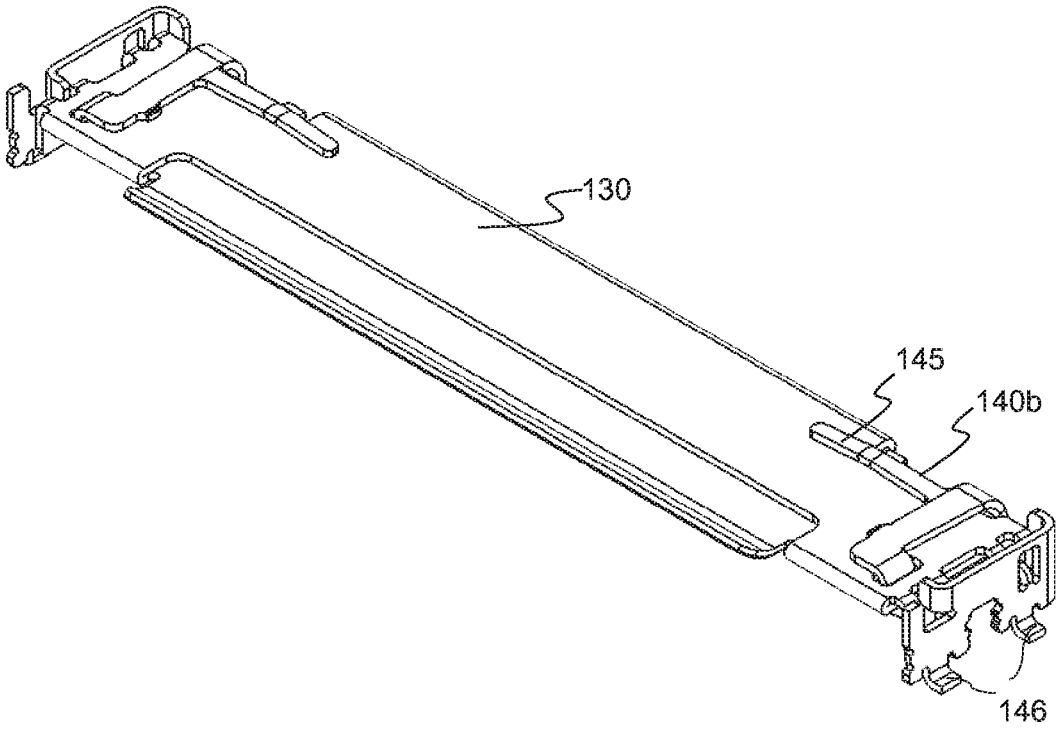
FIG. 7 is a perspective view of a metal actuator and a pair of fixing tabs of the electrical connector of FIG. 1.

FIG. 7 is a perspective view of the actuator 130 and the fixing tabs 140*a* and 140*b* of the connector 100 while other components of the connector 100 are omitted for the purpose of clear illustration. The contact portion 145 of the fixing tab 140*b* is in contact with the top side of actuator 130. The fixing tab 140*b* may have a second contact portion 143 extending laterally laterally from the spring portion 144, as shown in FIG. 6 in contact with the top side of actuator 130.

Figure 8:
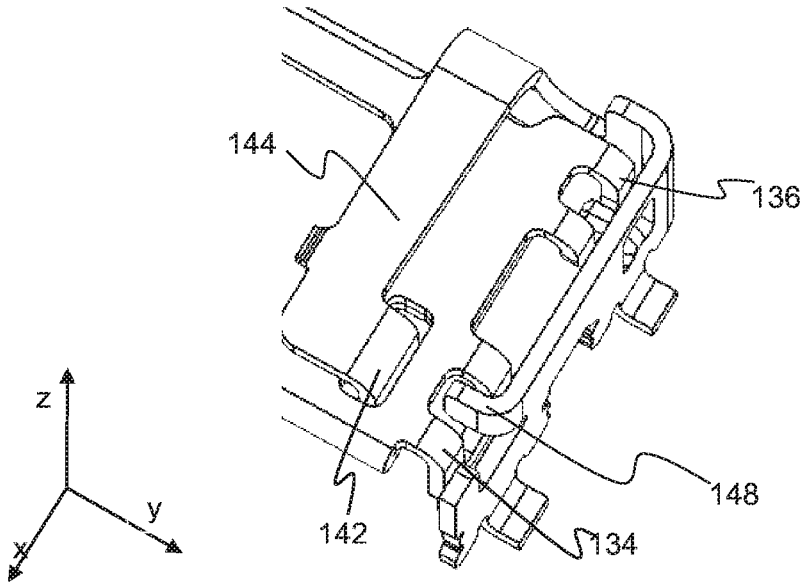
FIG. 8 is an enlarged partial top perspective view of the metal actuator and the pair of fixing tabs of the electrical connector of FIG. 7.
Figure 9:
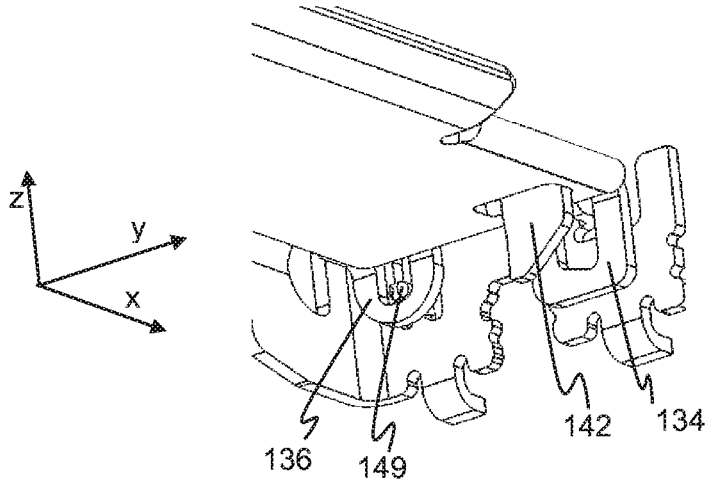
FIG. 9 is an enlarged partial bottom perspective view of the metal actuator and the pair of fixing tabs of the electrical connector of FIG. 7.

FIG. 8 is an enlarged partial top perspective view of the right end of the actuator 130 and the fixing tab 140*b* of the connector 100 and FIG. 9 is an enlarged partial bottom perspective view of the right end of the actuator 130 and the fixing tab 140*b* of the connector 100, showing the engagement between the actuator 130 and the fixing tab 140*b*. As mentioned above, although only the engagement between the actuator 130 and the fixing tab 140*b* positioned on the right side of the connector 100 is described, it can be understood that the actuator 130 is engaged with the fixing tab 140*a* positioned on the left side of the connector 100 in the same manner.

As shown in FIG. 7 to FIG. 9, fixing tab 140*b* is engaged to actuator 130 with the contact portion 145 and the spring portion 144 abutting against the top side of the actuator 130, the lock portion 142 extending downwardly and passing through the opening 132 of the actuator 130, the protrusion 148 positioned in the aperture of the limiting component 134 and the protrusion 149 positioned in the aperture of the limiting component 136.

It should be appreciated that the structures of the actuator 130 and the fixing tabs 140*a* and 140*b* are not limited to the embodiment disclosed above. In one example, the actuator 130 may include protrusions which are engaged with apertures formed on fixing tabs 140*a* and 140*b*. The protrusions may take various shapes and configurations. In another example, the actuator 130 may include a recess in place of the opening 132, for the lock portion 142 to pass through, or the lock portion 142 extends downward and abutting an edge of the actuator 130.

Figure 10:
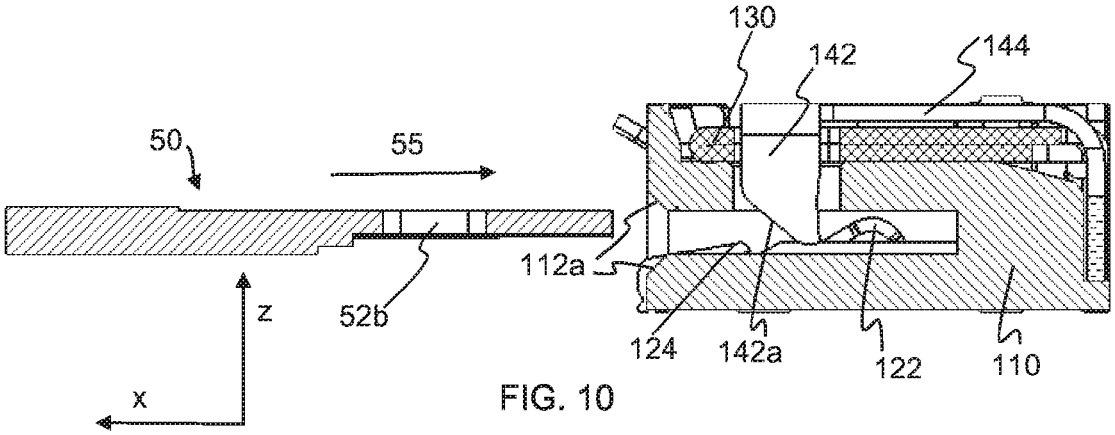
FIG. 10 to FIG. 12 show a connection process of an FPC to the electrical connector of FIG. 1.
Figure 11:
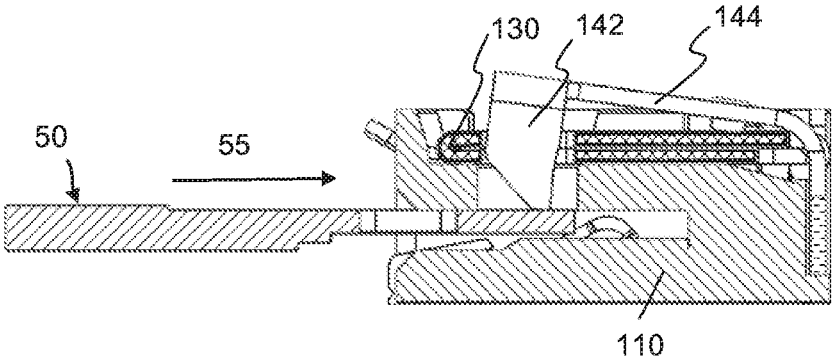
Figure 12:
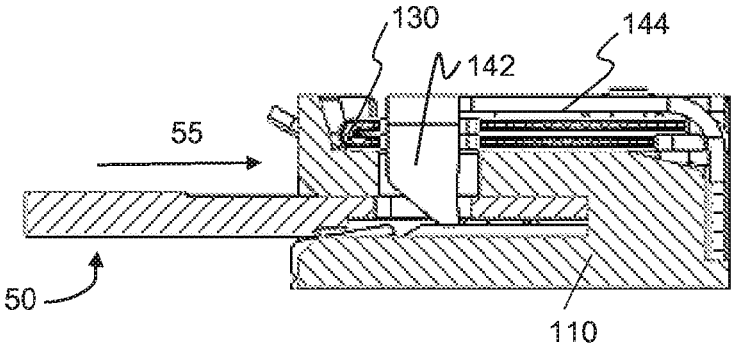

FIG. 10 to FIG. 12 shows the connection process of the FPC 50 to the connector 100. As shown in FIG. 10, the FPC 50 is being inserted along the negative x axis (shown as direction 55) into the slot 112 of the housing 110. The slot 112 of the housing 110 may have inclined surfaces 112*a* for guiding the FPC 50. As being inserted through slot 112, FPC 50 will come into contact with a slope surface 142*a* of the lock portion 142 and exert a force against the lock portion 142 along the insertion direction 55. Forced by the insertion of FPC 50, the lock portion 142 will be moved upward and thus clear the insertion pathway for the FPC 50 as shown in FIG. 11.

As it is further inserted, the FPC 50 will be stopped by the housing 110 at a connection position as shown in FIG. 12, where contacts 54 of FPC 50 are electrically connected to contacts 120 of connector 100. Upon FPC 50 reaching the connection position, recesses 52*a* and 52*b* (only recess 52*b* is shown in FIG. 12) are positioned to face lock portion 142. The lock portion 142 will resume to the original position following the downward resilient deflection of spring portion 144 and engage with the recess 52*b* of the FPC 50. The FPC 50 is now secured by the lock portion 142 such that unintentional removal of FPC 50 from the housing 110 is prevented.

As contact portion 145 and spring portion 144 abut against the top side of the actuator 130, actuator 130 remains stationary relative to housing 110 during the upward and downward movement of spring portion 144 during the insertion process of FPC 50 into housing 110.

Figure 13:
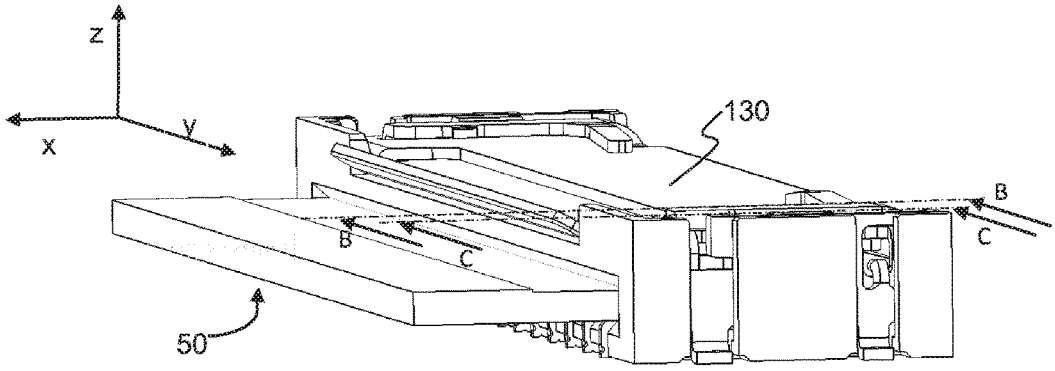
FIG. 13 is a perspective view of the electrical connector of FIG. 1 with an FPC connected thereto.
Figure 14:
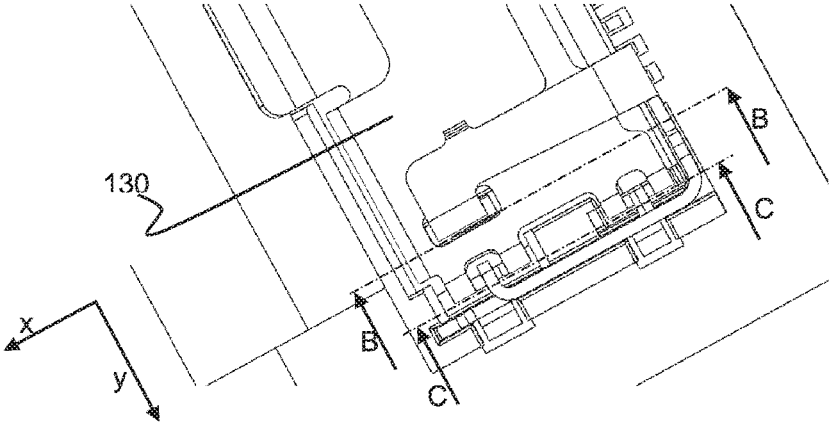
FIG. 14 is an enlarged partial top view of the electrical connector of FIG. 1 with an FPC connected thereto.
Figure 15:
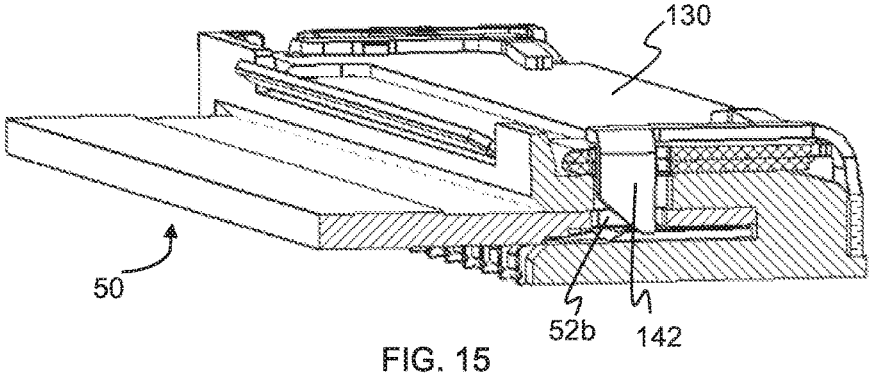
FIG. 15 is a cross-section view along B-B in FIG. 13 and FIG. 14.
Figure 16:
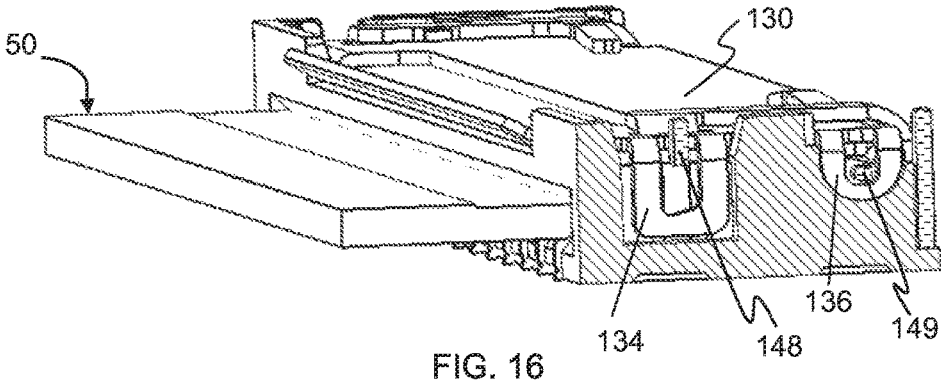
FIG. 16 is a cross-section view along C-C in FIG. 13 and FIG. 14.

FIG. 13 is a perspective view of the connector 100 with the FPC 50 connected thereto. FIG. 14 is an enlarged partial top view the connector 100 with the FPC 50 connected thereto. FIG. 15 is a cross-sectional view along B-B of FIG. 13 and FIG. 14. FIG. 16 is a cross-sectional view along C-C of FIG. 13 and FIG. 14.

It can be seen in FIG. 15, the lock portion 142 is positioned in the recess 52*b* of the FPC 50 to secure the FPC 50 in the housing to prevent unintentional disconnection of the FPC 50 from housing 110. The protrusions 148 and 149 of the fixing tab 140*b* are positioned at an upper portion of the apertures of the limiting components 134 and 136 of the actuator 130 where the actuator 130 is at the original position.

Figure 17:
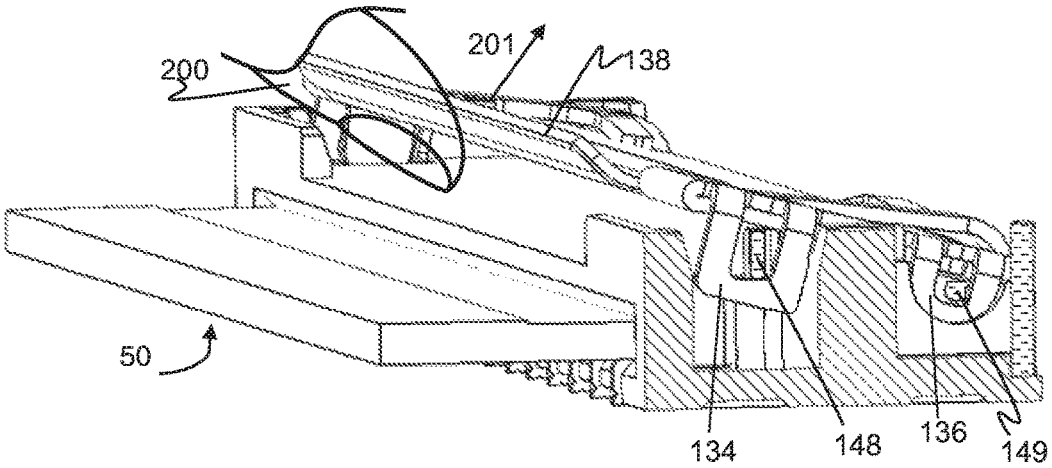
FIG. 17 to FIG. 19 show removal process of an FPC connected to the electrical connector of FIG. 1.
Figure 18:
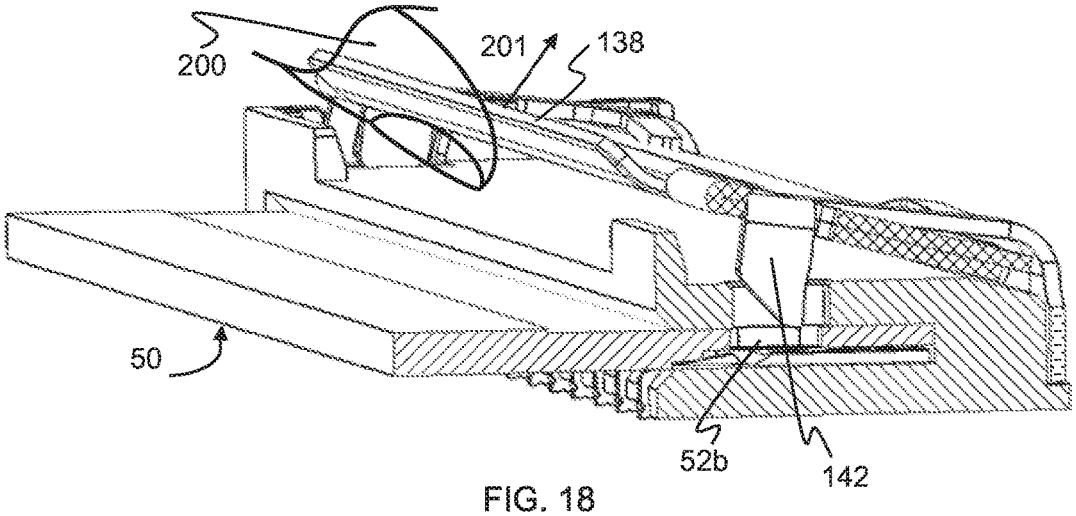
Figure 19:
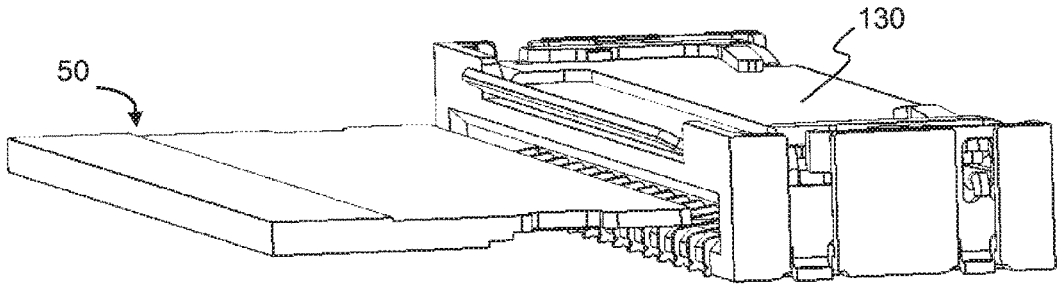

FIGS. 17 to 19 show a user-initiated removal process of the FPC 50 from the connector 100. The actuator 130 can be rotated by a user operating on the acting portion 138, shown in FIGS. 17 and 18 by a user finger 200 lifting acting portion 138 along opening direction 201, to rotate actuator 130 along opening direction 201.

As shown in FIG. 18, as being rotated toward the release position, actuator 130 acts against the spring portion 144 and contact portion 145 to cause the spring portion 144 to resiliently deflect upwardly. Accordingly, the lock portion 142 connected to the spring portion 144 is moved upward following the upward resilient deflection of the spring portion 144 and thus disengaged from recess 52*b* of the FPC 50.

Following the rotation of the actuator 130, the limiting components 134 and 136 of the actuator 130 will move upwardly. The rotation of the actuator 130 will be stopped at a release portion, as shown in FIG. 17, when the bottom edges of the apertures of limiting 149 of the fixing tab 140*b*.

The engagement between the bottom edges of limiting components 134 and 136 and the protrusions 148 and 149 limits the movement of actuator 130 at the release position. This engagement restricts the actuator 130 from rotating beyond the release position to prevent detachment of actuator 130 and fixing tabs 140*a*, 140*b* from housing 110. When the limiting components 134 and 136 of the actuator 130 are obstructed from rotating by the protrusions 148 and 149 of the fixing tab 140*b*, the lock portion 142 of the fixing tab 140*b* is disengaged from the recess 52*b* of the FPC 50, allowing removal of FPC 50 from housing 110 and disconnected from connector 100.

As the FPC 50 is removed from housing 110, user operation on acting portion 138 may be released. The resilient force from spring portion 144 acting against the top side of actuator 130 moves actuator 130 back to the original position, as shown in FIG. 19, allowing connection of an FPC to connector 100 again. Manually pushing the actuator 130 back to the original position is not required, FPC connection to the connector can be operated in a more efficient manner.

Figure 20:
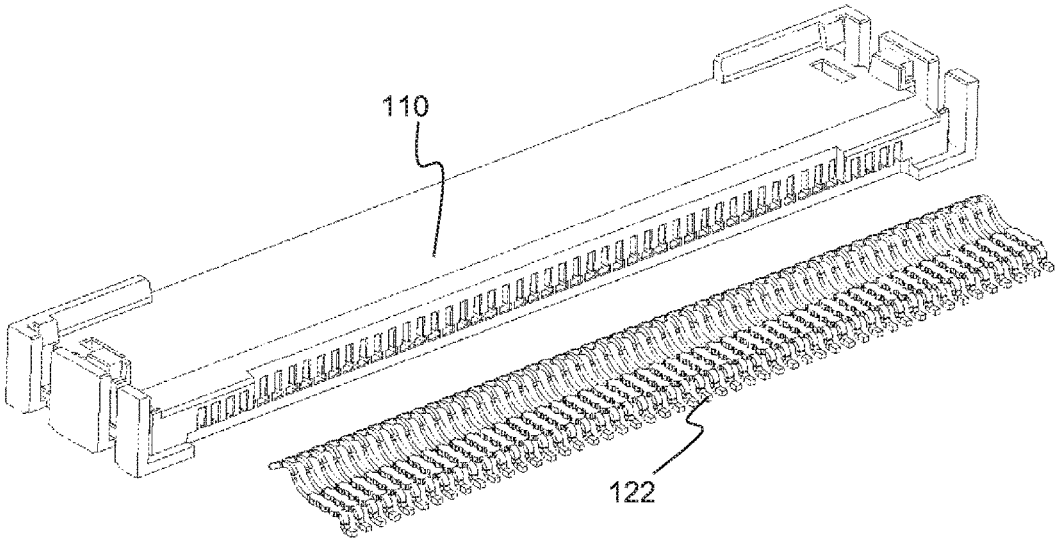
FIG. 20 to FIG. 25 show assembly process of the electrical connector of FIG. 1.
Figure 21:
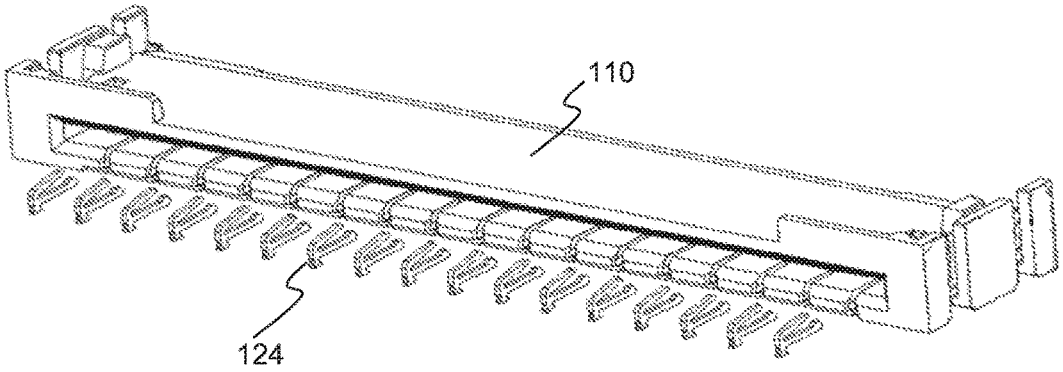
Figure 22:
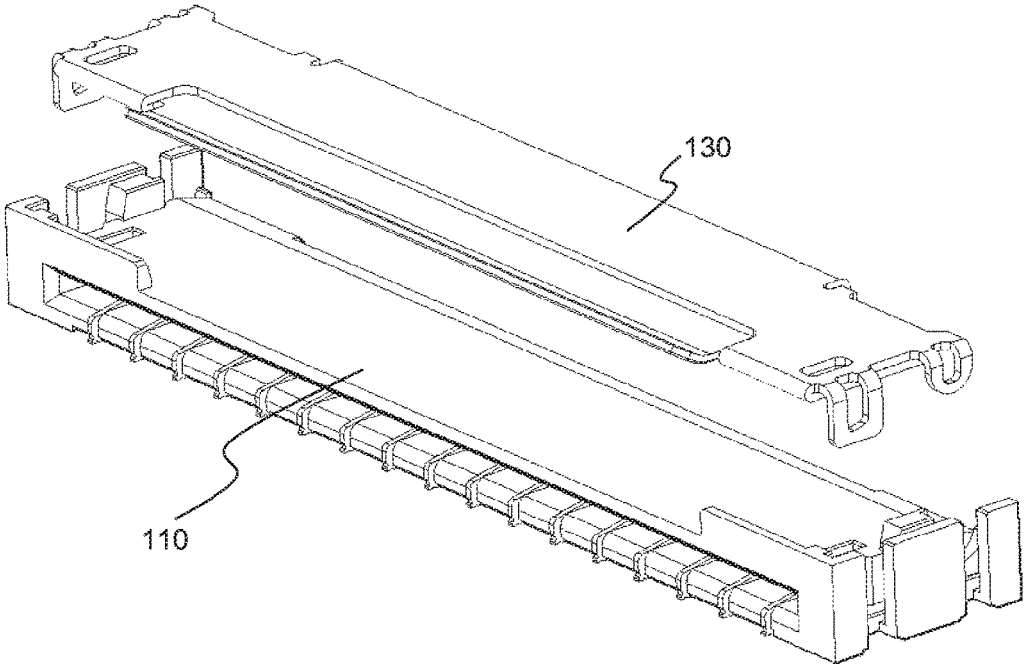
Figure 23:
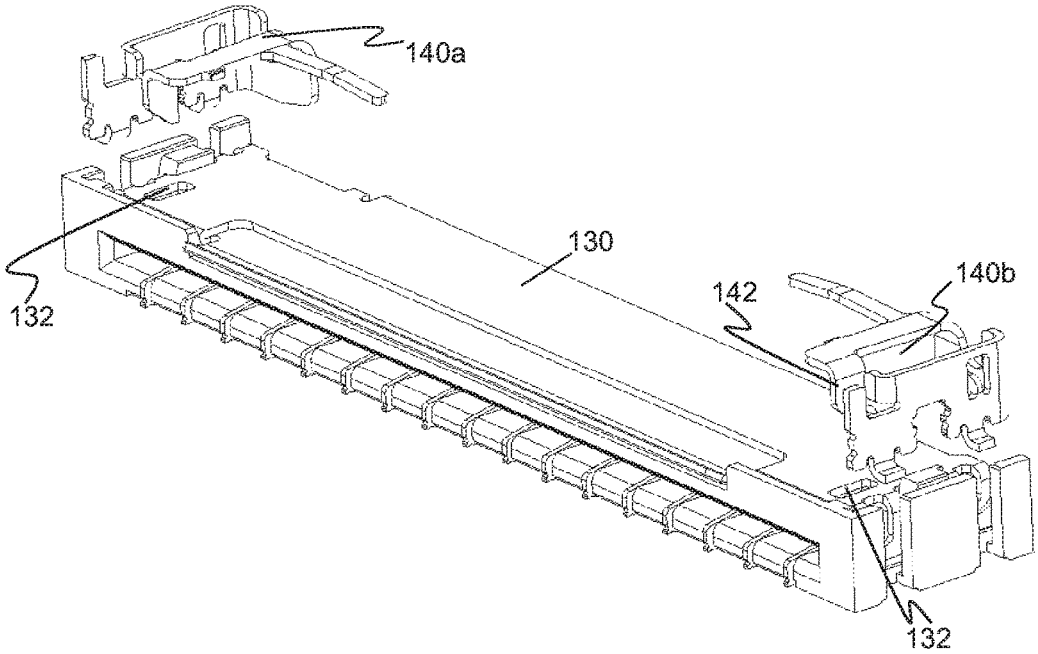
Figure 24:
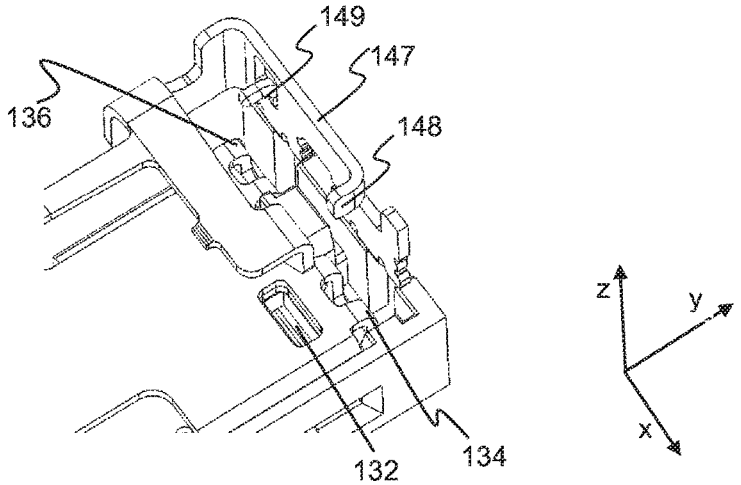
Figure 25:
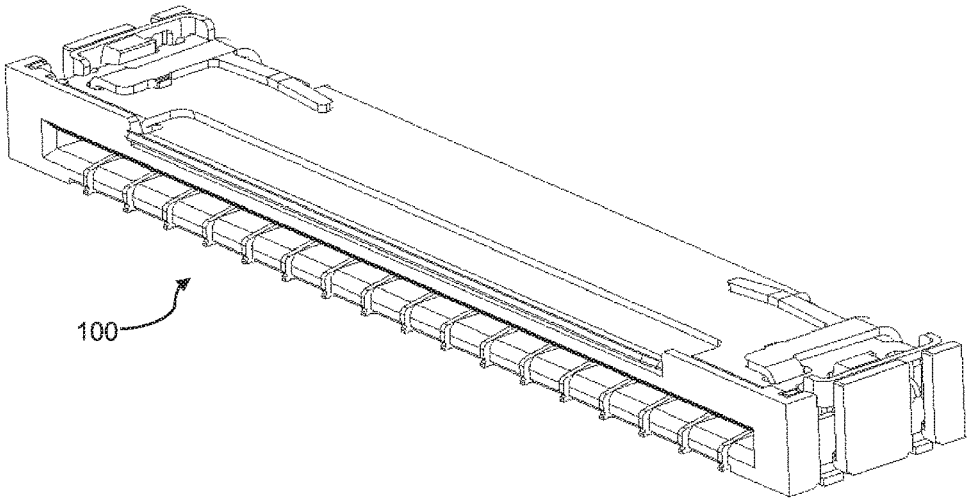

FIG. 20 to FIG. 25 show an assembly process of the connector 100 and FIG. 24 is an enlarged partial perspective view showing assembly of the pair of the fixing tabs 140*a* and 140*b*. As shown in FIG. 20, the signal contacts 122 are firstly assembled into the housing 110 from the back of the housing 110, the ground contacts 124 are then assembled into the housing from the front of the housing 110 as shown in FIG. 21. As seen in FIG. 22, actuator 130 is mounted onto the top of the housing 110. Lastly, as seen in FIG. 23, two fixing tabs 140*a* and 140*b* are assembled to housing 110, with the lock portion 142 positioned to pass through the openings 132 of the actuator 130, the protrusions 148 and 149 positioned in the aperture of each limiting components 134 and 136 of the actuator 130.

Thus, in accordance with the present embodiment, an advantageous high speed electrical connector is provided. The present electrical connector reduces operation procedures of FPC connection, as manually pushing the actuator of the connector back to the original position is not required, resulting in more efficiently connecting and re-connecting an FPC or FFC to the connector.

While exemplary embodiments have been presented in the foregoing detailed description of the invention, it should be appreciated that a vast number of variations exist. For example, the structure of the fixing tab could vary and the engagement between the fixing tabs and the actuator could also vary so long that rotation of the actuator from an original position to a release position causes the fixing tab to disengage from the flexible printed circuit connected to the electrical connector and the actuator resumes from the release position to the original position under a resilient force exerted thereon by the fixing tab.

It should further be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

The invention claimed is:

1. An electrical connector, comprising:
a housing;
a plurality of contacts arranged in the housing;
an actuator mounted on the housing, capable of rotating with reference to the housing; and
a pair of fixing tabs positioned in the vicinity of two ends of the actuator, the fixing tabs each having a lock portion for engaging with a flexible printed circuit connected to the electrical connector and a spring portion connected to the lock portion,
wherein each fixing tab of the pair of fixing tabs is engaged with the actuator so that rotation of the actuator from an original position to a release position causes the lock portions of the pair of fixing tabs to disengage with the flexible printed circuit connected to the electrical connector and the actuator resumes from the release position to the original position under a resilient force exerted thereon by the spring portions of the pair of fixing tabs, and
wherein the lock portions and the actuator are configured to rotate in a same upward direction during rotation of the actuator between the original position and the release position and a same downward direction when the actuator resumes from the release position to the original position.

2. The electrical connector of claim 1, wherein each fixing tab comprises at least one soldering portion.

3. The electrical connector of claim 1, wherein each fixing tab comprises a protrusion configured to engage with a limiting component formed on one of the two ends of the actuator, thereby limiting the rotation of the actuator.

4. The electrical connector of claim 1, further comprising a slot formed in the housing for receiving the flexible printed circuit therein.

5. The electrical connector of claim 4, wherein the lock portion is configured to extend into the slot so as to engage with a recess formed in the flexible printed circuit when the flexible printed circuit is received in the slot.

6. The electrical connector of claim 1, wherein the lock portion has a sloped surface.

7. The electrical connector of claim 1, wherein each spring portion comprises a contact portion extending from the spring portion and engaging with a top surface of the actuator during rotation between the original position and the release position.

8. The electrical connector of claim 1, wherein the actuator comprises an opening, and a portion of spring portion passes through the opening.

9. The electrical connector of claim 1, wherein the actuator comprises an acting portion protruding from the housing.

10. An electrical connector, comprising:
a housing;
a plurality of contacts arranged in the housing;
an actuator mounted on the housing, capable of rotating with reference to the housing; and
a fixing tab positioned in the vicinity of an end of the actuator, the fixing tab having a lock portion for engaging with a flexible printed circuit connected to the electrical connector and a spring portion connected to the lock portion, wherein the fixing tab comprises a protrusion configured to engage with a limiting component formed on one of the two ends of the actuator, thereby limiting the rotation of the actuator, wherein the limiting component comprises an opening formed therein, wherein the fixing tab is engaged with the actuator so that rotation of the actuator from an original position to a release position causes the lock portion of the fixing tab to disengage with the flexible printed circuit connected to the electrical connector and the actuator resumes from the release position to the original position under a resilient force exerted thereon by the spring portion of the fixing tab.

11. A method comprising:

inserting a printed circuit in a slot formed in a housing of an electrical connector;

with an edge of the printed circuit, causing respective spring portions of a pair of fixing tabs to resiliently deflect, thereby clearing an insertion pathway for the printed circuit, the pair of fixing tabs being mounted on the housing, wherein the pair of fixing tabs are positioned in the vicinity of two ends of an actuator mounted to the housing and configured to disengage the pair of fixing tabs wherein the respective spring portions are configured to resiliently deflect independently from the actuator when caused to resiliently deflect by the edge of the printed circuit;

electrically contacting a plurality of contact portions of the electrical connector with a plurality of contact portions of the printed circuit; and causing the spring portion to be released thereby engaging the pair of fixing tabs with the printed circuit.

12. The method of claim 11, wherein the spring portion is released when the edge of the printed circuit abuts the housing.

13. The method of claim 12, wherein, when the edge of the printed circuit abuts the housing, a lock portion of each of the pair of fixing tabs engages with a recess formed in the printed circuit.

14. The method of claim 12, wherein, when the edge of the printed circuit abuts the housing, a lock portion of each of the pair of fixing tabs passes through an opening formed in the housing.

15. The method of claim 11, further comprising releasing the printed circuit from the electrical connector by:

causing the actuator to rotate with respect to the housing; and causing the respective spring portions to resiliently deflect thereby disengaging the fixing tab from the printed circuit.

16. The method of claim 15, further comprising limiting rotation of the actuator by causing a limiting component of the actuator to engage with a protrusion formed in the fixing tab.

17. The method of claim 15, further comprising sliding the printed circuit away from the electrical connector.

18. The method of claim 17, wherein sliding of the printed circuit away from the electrical connector causes the spring portion to be released.

19. The electrical connector of claim 4, wherein the actuator is disposed directly above the slot.

20. The electrical connector of claim 9, wherein each fixing tab comprises a protrusion configured to engage with limiting components formed on the two ends of the actuator, wherein the actuator is configured to rotate about an axis between the respective protrusions in response to a force applied to the acting portion.

* * * * *